US006305246B1

(12) United States Patent
Horvath

(10) Patent No.: US 6,305,246 B1
(45) Date of Patent: Oct. 23, 2001

(54) RATCHET WRENCH HEAD WITH LUBRICATION PORT

(75) Inventor: John Horvath, Cuyahoga Falls, OH (US)

(73) Assignee: Mechanics Custom Tools Corporation, Wilmington, DE (US)

( * ) Notice: Subject to any disclaimer, the term of this patent is extended or adjusted under 35 U.S.C. 154(b) by 0 days.

(21) Appl. No.: 09/470,414

(22) Filed: Dec. 22, 1999

(51) Int. Cl.[7] ..... B25B 17/00
(52) U.S. Cl. ..... 81/57.39; 81/60
(58) Field of Search ..... 81/57.39, 54, 58, 81/60

(56) References Cited

U.S. PATENT DOCUMENTS

| | | | | |
|---|---|---|---|---|
| 2,217,740 | | 10/1940 | Ehnts . | |
| 2,483,544 | | 10/1949 | Jacobsen . | |
| 3,498,186 | | 3/1970 | Northcutt . | |
| 3,529,498 | | 9/1970 | Northcutt . | |
| 3,614,182 | * | 10/1971 | Rozentals | 308/72 |
| 4,116,093 | | 9/1978 | DePagter . | |
| 4,346,630 | * | 8/1982 | Hanson | 81/57.13 |
| 4,374,480 | * | 2/1983 | Diaz | 81/57.3 |
| 4,507,990 | * | 4/1985 | Lack | 81/57.39 |
| 4,720,000 | | 1/1988 | Snyder . | |
| 4,987,803 | | 1/1991 | Chern . | |
| 5,054,584 | | 10/1991 | Hoffman . | |
| 5,301,574 | * | 4/1994 | Knopp et al. | 81/57.39 |
| 5,535,646 | | 7/1996 | Allen et al. . | |
| 5,537,899 | | 7/1996 | Diedrich . | |

OTHER PUBLICATIONS

Three (3) Photographs of a Prior Art Pneumatic Ratchet Wrench manufactured by Snap–On Incorporated.

Operator Instructions for the Prior Art Pneumatic Ratchet Wrench manufactured by Snap–On Incorporated, Applicant'reference AM.

One (1) photograph of a prior art Sears Craftsman hand ratchet wrench.

* cited by examiner

*Primary Examiner*—Joseph J. Hail, III
*Assistant Examiner*—David B. Thomas
(74) *Attorney, Agent, or Firm*—Oldham & Oldham Co., LPA; Alexander D. Bommarito

(57) ABSTRACT

A lubrication port is placed in the yoke of a pneumatic powered ratchet wrench or the head of a hand powered ratchet wrench. The lubrication port is placed so that it intersects with the teeth formed on the circumference of the bore formed in the yoke or the ratchet head which come in contact with the teeth formed on the outer ends of the pawl(s) of a ratchet mechanism. This allows for the application of lubricants, preferably grease, to the area of engagement between the teeth formed on the circumference of the bore of the yoke, ratchet head or ratchet mechanism and the teeth formed on the outer ends of the pawl(s) of a ratchet mechanism. Application of lubricants through the lubrication port of the present invention also allows for lubrication of the moving components of the ratchet assembly. Moreover, in a pneumatic powered ratchet wrench the lubrication port allows for application of lubricants to the drive bushing and crank of the wrench. Optionally, this port may be bored to apply lubricants directly to the drive bushing and crank of a pneumatic wrench. Preferably, a grease fitting is affixed within the inlet portion of the lubrication port of the present invention to further aid in application of lubricants.

7 Claims, 8 Drawing Sheets

RATCHET WRENCH HEAD WITH LUBRICATION PORT

FIELD OF THE INVENTION

The present invention is generally a lubrication port formed within the head of a ratchet wrench. More specifically, the present invention is a lubrication port within a yoke or ratchet wrench head for the application of grease or other lubricants to the area of engagement between the teeth formed on the pawl(s) of the ratchet mechanism of the wrench and the teeth formed within the yoke or head of a ratchet wrench.

BACKGROUND OF THE INVENTION

Pneumatic and hand powered ratchet wrenches are well known in the art. Such wrenches typically consist of a ratchet mechanism having a shift lever and a drive square for receiving a socket. The shift lever is coupled to at least one pawl which is pivotally mounted and has teeth formed on its outer ends. The pawl(s) are mounted in a manner to engage teeth formed on the inner surface of the yoke, ratchet head or teeth on the outer circumference of the ratchet mechanism. Rotation of the shift lever to one position urges one end of the pawl or pawls into engagement with the teeth of the yoke, ratchet head or ratchet mechanism. The pawl or pawls prevent rotation of the drive square and socket in one direction while allowing rotation in the opposite direction. Switching the shift lever to the second position pivots the pawl(s) causing the engaged teeth on the pawl(s) to become disengaged while causing the teeth on the opposite end of the pawl(s) to be urged against and engage with the teeth of the yoke, ratchet head or ratchet mechanism.

It is beneficial to lubricate the area of engagement between the teeth formed on the yoke, ratchet head or ratchet mechanism of the wrench and teeth formed on the ends of the pawl(s) to prevent excessive wear of these teeth and to allow the pawl(s) to pivot more easily within the bore of the yoke. In the past, this was accomplished by removing the ratchet mechanism and applying grease or other lubricants to the ratchet mechanism, the pawl(s) and the teeth of the yoke wrench head or the ratchet mechanism.

More recently, manufacturers have placed a grease fitting for application of lubricants in the shift lever of a self-contained ratchet mechanism. However, grease fittings within the self-contained ratchet mechanism do not supply the necessary lubrication directly to the area of engagement between the teeth formed on the pawl(s) and the teeth formed in the inner surface of the yoke of the wrench or wrench head, or the teeth formed on the outer circumference of the ratchet mechanism.

Thus, there is a need to provide a ratchet wrench with a port formed within the yoke of a pneumatic wrench or the ratchet head of a hand wrench for application of lubricants to the area of engagement between the teeth formed on the outer ends of the pawl(s) of the wrench and the teeth formed in the inner surface of the yoke, ratchet head or the teeth formed on the outer circumference of the ratchet mechanism.

SUMMARY OF THE INVENTION

It is a general object of the present invention to provide a yoke having a lubrication port for use with a ratchet wrench which is usable with any number of different ratchet mechanisms and thus different pneumatic ratchet wrenches.

It is another object of this invention to provide a yoke having a lubrication port that allows for the application of lubricants to the area of engagement between the teeth formed on the pawl(s) and the teeth formed on the inner surface of the yoke of a pneumatic ratchet wrench.

It is another object of this invention to provide a yoke having a lubrication port that allows for the application of lubricants to the ratchet mechanism and other moving components of a pneumatic ratchet wrench.

It is yet another object of the present invention to provide a yoke having a lubrication port having a grease fitting affixed within the port for application of grease to the area of engagement between the teeth formed on the pawls and the teeth formed on the inner surface of the yoke, to the ratchet mechanism and to other moving components of a pneumatic ratchet wrench.

It is a further object of the present invention to provide a hand operated ratchet wrench with a lubrication port that allows for the application of lubricants to the area of engagement between the teeth formed on the pawl(s) and the teeth formed on the inner surface of the ratchet head or teeth formed on the circumference of the ratchet mechanism.

It is still another object of the present invention to provide a ratchet wrench with a lubrication port which allows for application of lubricants to the ratchet mechanism and other moving components of the ratchet wrench.

It is yet another object of the present invention to provide a ratchet wrench with a lubrication port having a grease fitting affixed within the port for application of grease to the area of engagement between the teeth formed on the pawls and the teeth formed on the inner surface of the ratchet head or teeth formed on the circumference of the ratchet mechanism.

These and other objects of the present invention are accomplished by having a port originating on the outer surface of the yoke or ratchet head and terminating at the inner surface of the yoke or ratchet head, so that the port communicates with the bore formed in the yoke of a pneumatic powered ratchet wrench or the ratchet head of a hand powered ratchet wrench. The terminal end of the port may intersect with a number of the teeth formed on the inner surface of the yoke or ratchet head bore or may terminate in the ratchet head bore adjacent to teeth located on the ratchet mechanism contained therein. The port acts as a channel to allow grease or other lubricants to be applied to the teeth formed on the pawl(s) of the ratchet mechanism and the teeth formed on the inner surface of the yoke or ratchet head bore or the circumference of the ratchet mechanism and lubricate the same. In the preferred embodiment, a grease fitting is placed within the port of the yoke to allow for ease of application of the lubricants and to retain the lubricants within the port and wrench assembly.

DETAILED DESCRIPTION OF THE PREFERRED EMBODIMENT

Reference will now be made in detail to the present preferred embodiments of the present invention, examples of which are illustrated in the accompanying drawings. Whenever possible, the same reference numbers will be used throughout the drawings to refer to the same or like parts.

Figure 1:
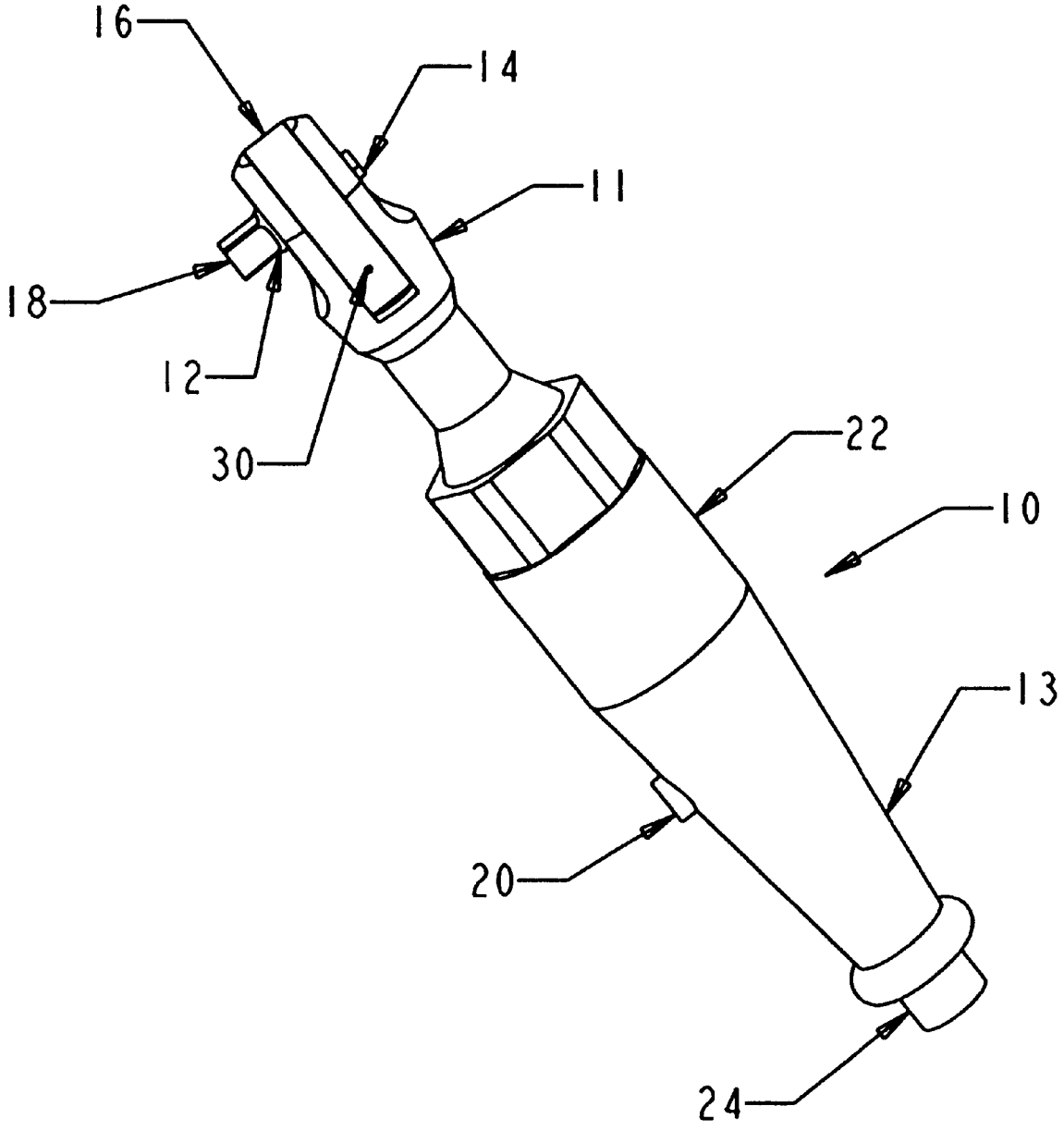
FIG. 1 is a perspective view of pneumatic ratchet wrench having a yoke with a lubrication port.
Figure 1A:
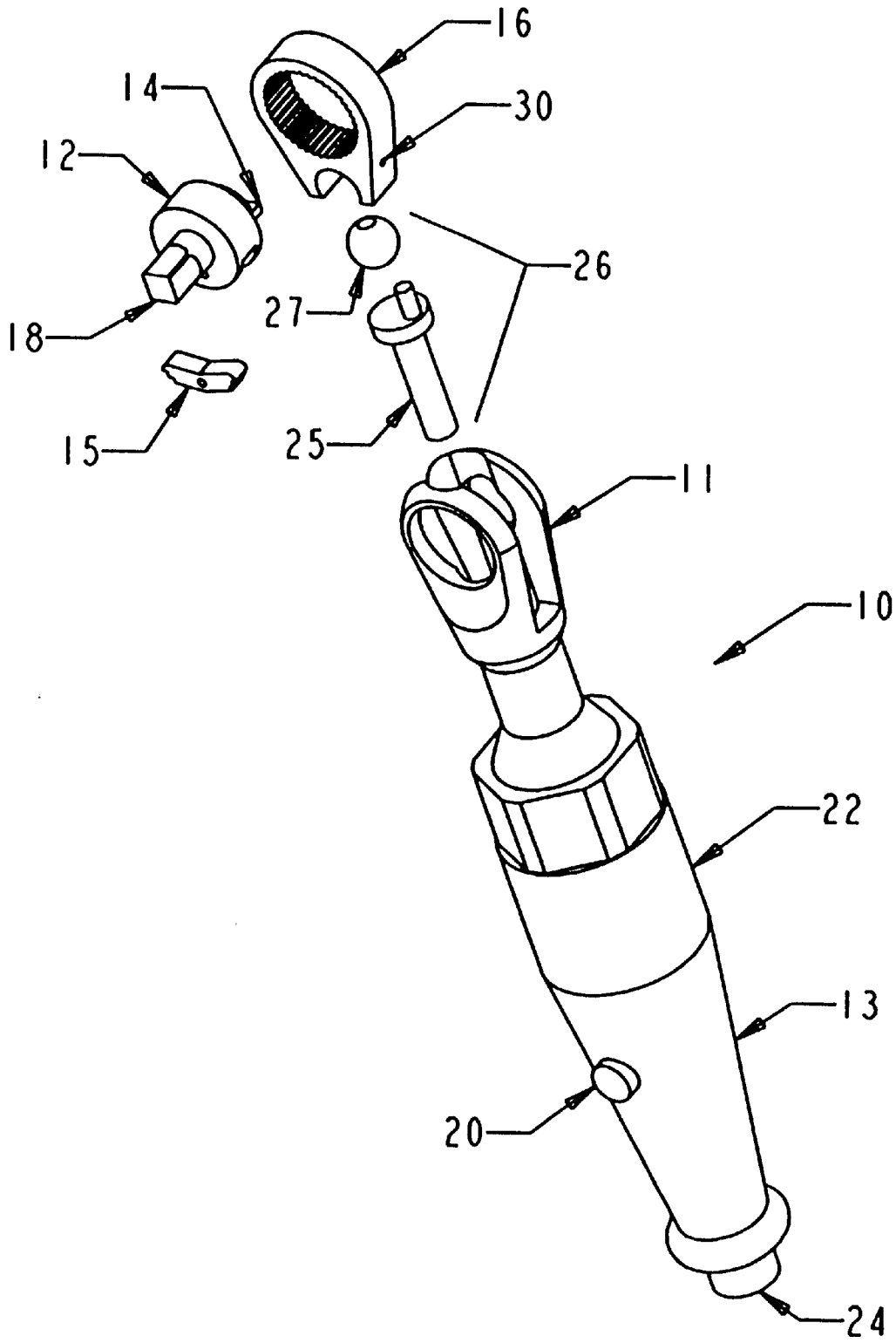
FIG. 1A is an exploded perspective view of having a yoke with a lubrication port.

Referring to FIGS. 1 and 1A, there is shown a pneumatic powered ratchet wrench as is known in the art shown generally at 10, having a head portion 11 and a handle portion 13. Head portion 11 contains a ratchet mechanism 12 having a shift lever 14, a drive square 18 and pawl 15. It is to be understood that ratchet mechanism 12, may have more than one pawl 15 mounted therein. Ratchet mechanism 12 fits within a yoke 16 in order to allow for rotation of the drive square 18. Yoke 16 and in turn, ratchet mechanism 12 are driven by drive mechanism 26, which consists of a drive bushing 27 and a crank 25. Drive mechanism 26 is powered by a motor located in the housing 22 of the wrench 10. Although a pneumatic motor is described as the preferred power source, and is well known in the art, other motors such as electric motors, can also be used to drive the ratchet wrench. The end of handle portion 13 contains a compressed air inlet port 24, which connects to a compressed air supply by various means known in the art. An actuation button 20 is located between air inlet port 24 and housing 22, which allows the operator to actuate the pneumatic motor, the drive mechanism 26 and the ratchet mechanism 12. This actuator may be a button as shown, or a lever or any other type of throttle valve activating device known and used in the art.

Figure 4:
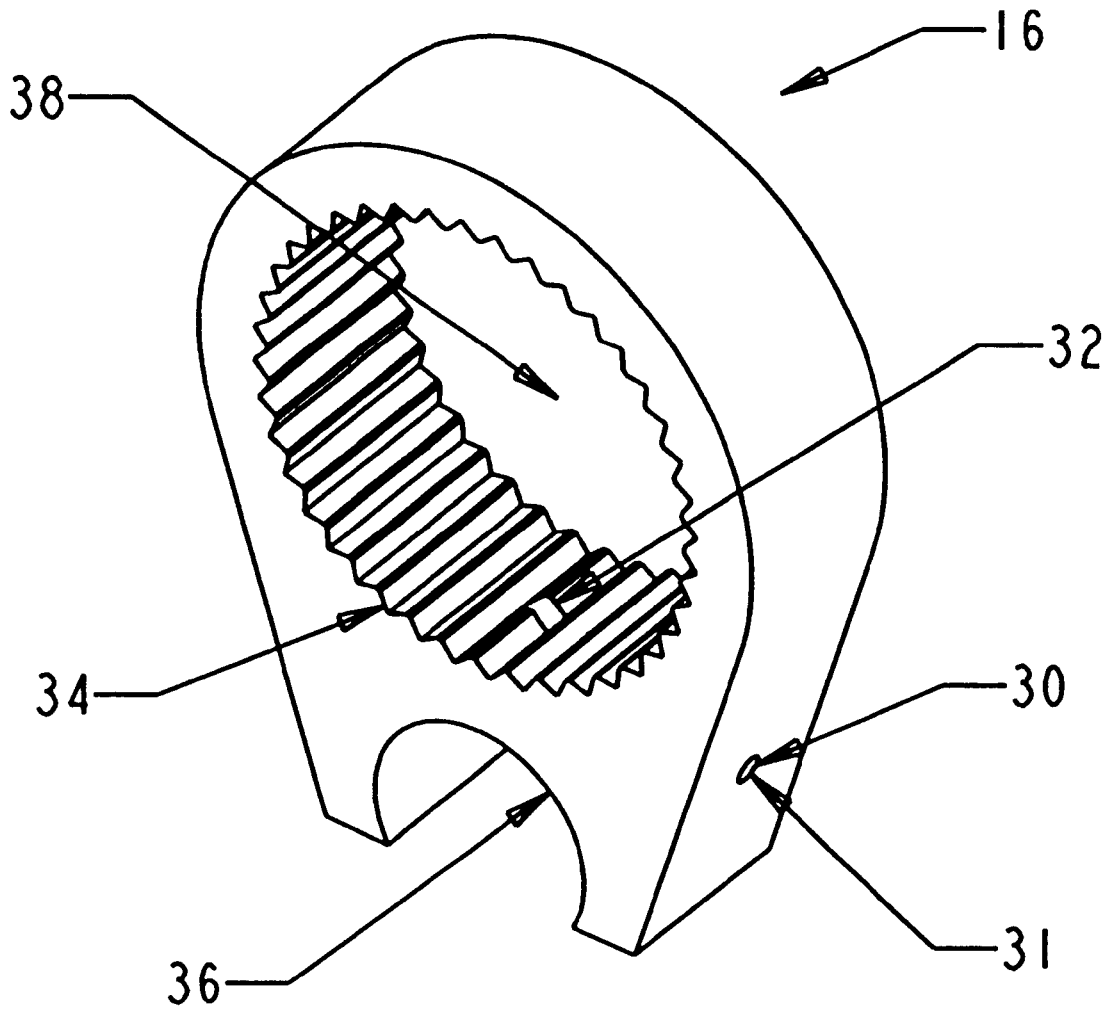
FIG. 4 is a perspective view of the yoke of the present invention.

Now referring to FIG. 4, there is shown a first embodiment of the present invention. Yoke 16 is shown removed from the head of the pneumatic ratchet wrench of FIG. 1. Yoke 16 has teeth 34 formed on its inner surface and a drive bushing journal 36 for engagement with the drive bushing 27 of the wrench. Yoke 16 further has a lubrication port 30 formed through outer surface of yoke 16 and into bore 38 of yoke 16. Port 30 has an inlet 31 on the outer wall of yoke 16 for accepting the desired lubricant and terminates at outlet 32 which intersects with teeth 34 for application of lubricant to teeth 34 on the inner surface of yoke 16.

Port 30 allows for application of lubricants to the area of engagement between the teeth formed on the outer ends of the pawl(s) of ratchet mechanism 12 and teeth 34 formed on the inner surface of yoke 16. Although various lubricants can be applied through port 30, grease provides better and longer lasting lubrication while also having better adhesive properties than other lubricants such as oils. Applying grease to the area of engagement between the pawl(s) of the ratchet mechanism 12 and teeth 34 improves the operation of the wrench and prevents excessive wear of both the teeth formed on the outer ends of the pawl(s) and teeth 34 formed on the inner surface of the yoke 16 thereby decreasing maintenance and repair of the wrench 10 and increasing the life of the pneumatic wrench.

The grease or other lubricant is applied to all of teeth 34 through the action of the pawl(s) of the ratchet mechanism traveling about the circumference of bore 38. Application of additional lubricant to port 30 causes lubricant to be applied to the moving components of the ratchet mechanism 12. When the ratchet wrench has been properly lubricated, application of lubricant to port 30 is stopped.

Figure 2:
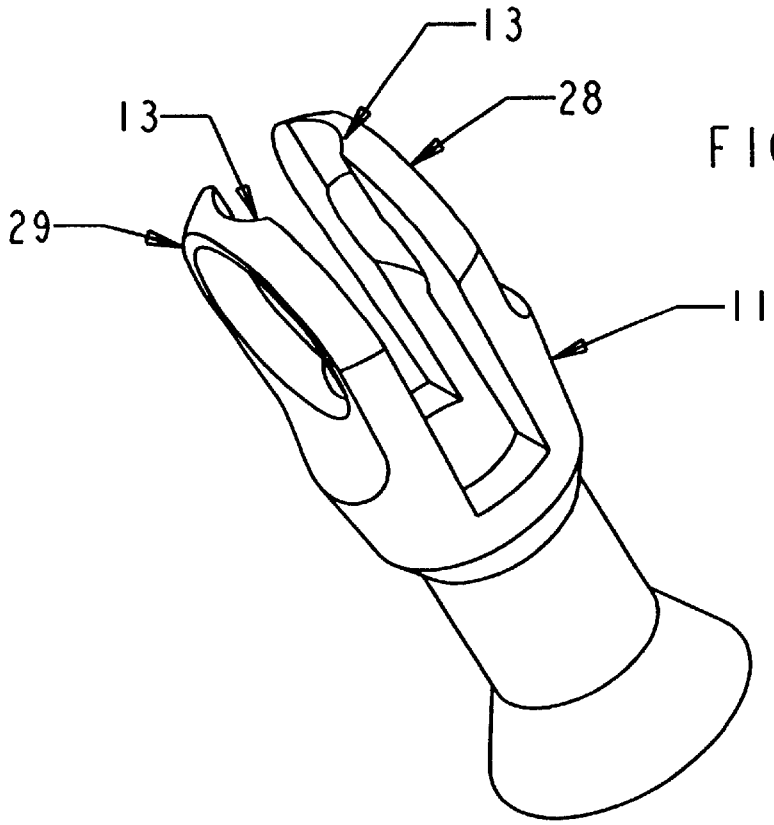
FIG. 2 is a perspective view of the head portion of a pneumatic powered ratchet wrench with the yoke of the present invention removed.
Figure 3:
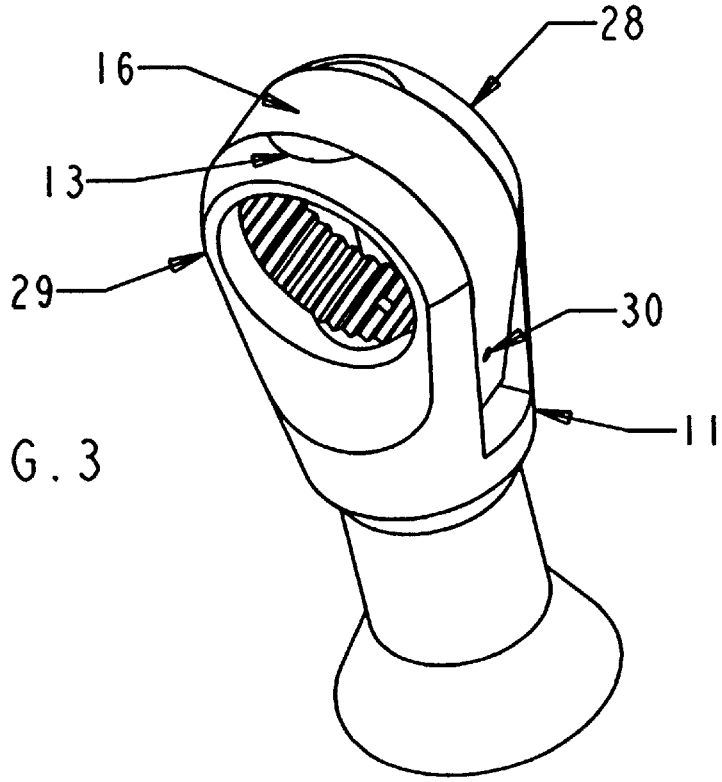
FIG. 3 is a perspective view of the yoke of the present invention within the head portion of a pneumatic powered ratchet wrench.

In FIGS. 2 and 3, head portion 11 of a pneumatic powered ratchet wrench is shown with the ratchet mechanism removed. Head portion 11 has an upper ear 28 and a lower ear 29. Each of the ears 28, 29 have a scallop 13 formed on the interior surface of cars 28, 29 to allow for placement of the drive bushing 27 and crank 25. It is not necessary that the yoke of the present invention be used in conjunction with a ratchet head as shown in FIGS. 2 and 3, however use of such a ratchet head with the yoke 16 of the present invention allows lubricant applied via the lubrication port 30 to travel through scallops 13 and lubricate the crank 25 and drive bushing 27 of the pneumatic powered ratchet wrench. After the crank 25 and the drive bushing 27 of the pneumatic powered ratchet wrench are positioned into the housing of the pneumatic wrench, the yoke 16 is placed between the ears 28, 29 of the head 11 in a manner that the drive bushing journal 36 comes into contact with and can be driven by the drive bushing 27 and crank 25. Lubricant is applied through lubrication port 30 and as ratchet mechanism 12 travels around the circumference of bore 38, lubricant is forced into scallops 13 and provides lubrication to the crank 25, the area of engagement between the crank 25 and drive bushing journal 36, and the area of engagement between drive bushing 27 and drive bushing journal 36.

Figure 8:
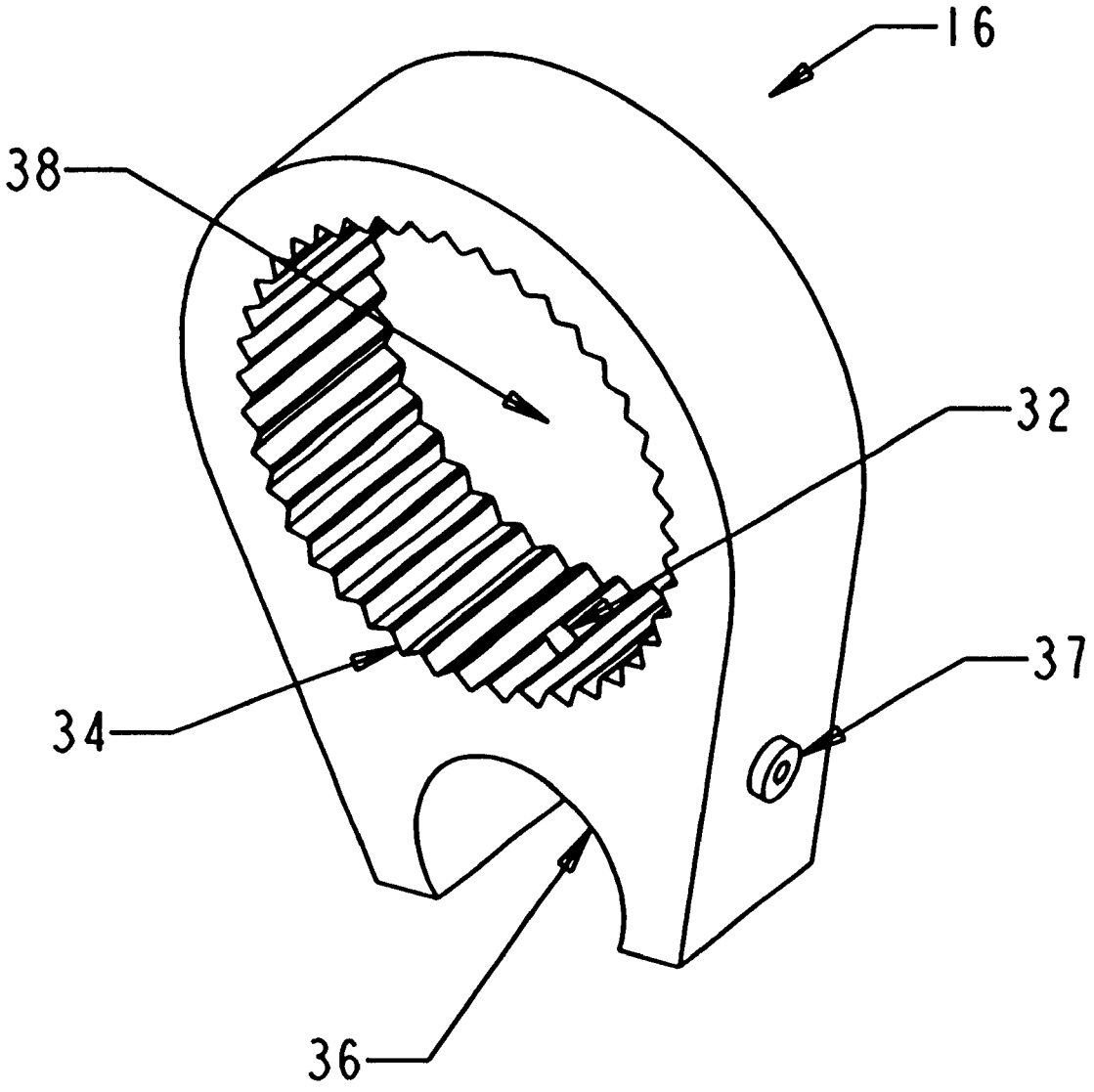
FIG. 8 is a perspective view of the yoke with a lubrication port having a grease fitting at the inlet end of the port.

As shown in FIG. 8, port 30 may optionally have a grease fitting 37 affixed within the inlet 31 of port 30. As the grease fitting interfaces with the nozzle of a grease gun, the fitting aids in application of the grease into the port 30. The fitting also aids in retention of the grease within port 30 and bore 38. Fitting 37 can be any one of various types of grease fittings commercially available or known and used in the art.

Figure 5:
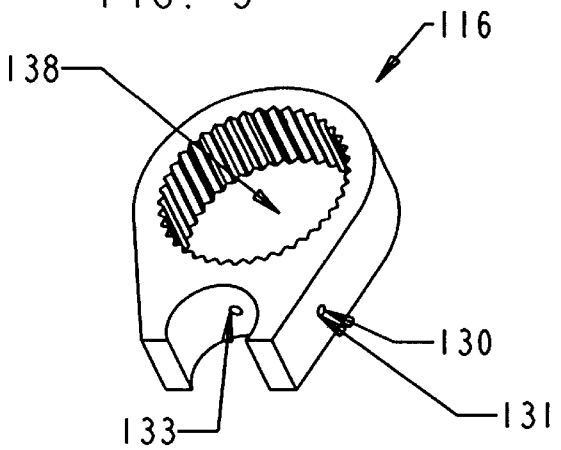
FIGS. 5 and 5A are perspective views of the yoke with a lubrication port which extends to the drive bushing journal.
Figure 5A:
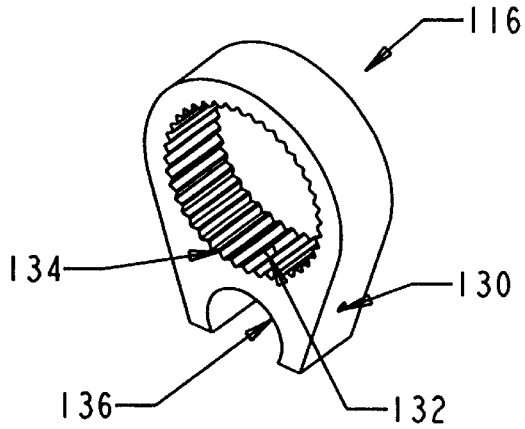
Figure 6:
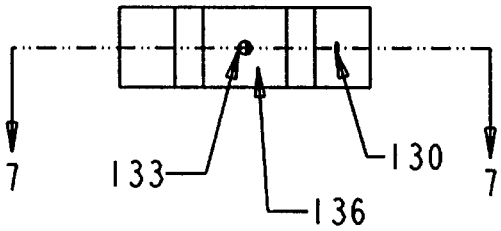
FIG. 6 is a bottom elevational view of the yoke with a lubrication port which extends to the drive bushing journal.
Figure 7:
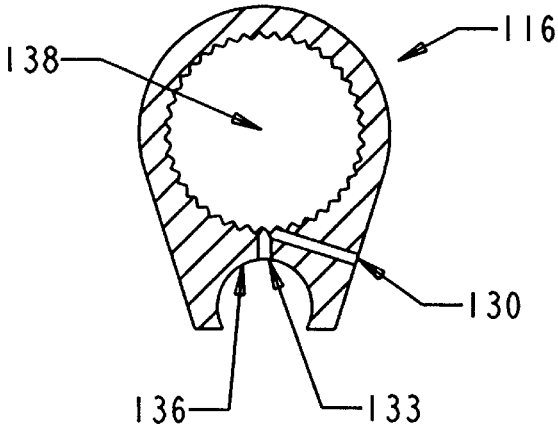
FIG. 7 is a sectional view taken along line 7—7 of FIG. 6 illustrating the yoke of FIG. 6 having a lubrication port which extends to the drive bushing journal.

Now referring to FIGS. 5, 5A and 6, a second embodiment of the yoke of the present invention is shown. Like the first embodiment, yoke 116 has teeth 134 for engagement with the teeth formed on the outer ends of the pawl(s) of the ratchet mechanism and a drive bushing journal 136 which contacts and is driven by the drive mechanism 26, of the pneumatic ratchet wrench as shown in FIG. 1A. This embodiment also comprises a yoke 116 with a first and second lubrication port. The first lubrication port 130 having an inlet 131 and an orifice 132. Orifice 132 acts as an outlet for lubrication placed within first lubrication port 130 through inlet 131, and an inlet for lubrication to pass through first lubrication port 130 by orifice through second lubrication port 135 and through outlet 133. The first and second lubrication ports of yoke 116 arc in direct fluid communication with each other by means of shared common orifice 132. Therefore, a portion of grease or other lubrications introduced into inlet 131 of lubrication port 130 exits yoke 116 at orifice 132, while a portion of the lubricant will be forced through the second lubrication port 135 to exit at outlet 133. Due to the typically tight clearances between the yoke 116 and the ratchet mechanism 12, displacement of lubricant through second lubrication port 135 and outlet 133 is further enhanced when the ratchet wrench 10 is assembled having ratchet mechanism 12 adjacent to orifice 132, assisting in directing lubricant down second lubrication port 135. Outlet 132 allows for application of grease or other lubricants to the area of engagement between the teeth 134 formed on the inner surface of yoke 116 and the teeth formed on the outer ends of the pawl(s) of the ratchet mechanism of the wrench. Outlet 133 allows for direct application of grease or other lubricants to the drive bushing and drive crank of the pneumatic wrench with which yoke 116 is used.

As described in association with port 30 and yoke 16 of the previous embodiment, port 130 may optionally have a grease fitting affixed within inlet 131 of port 130.

Figure 9:
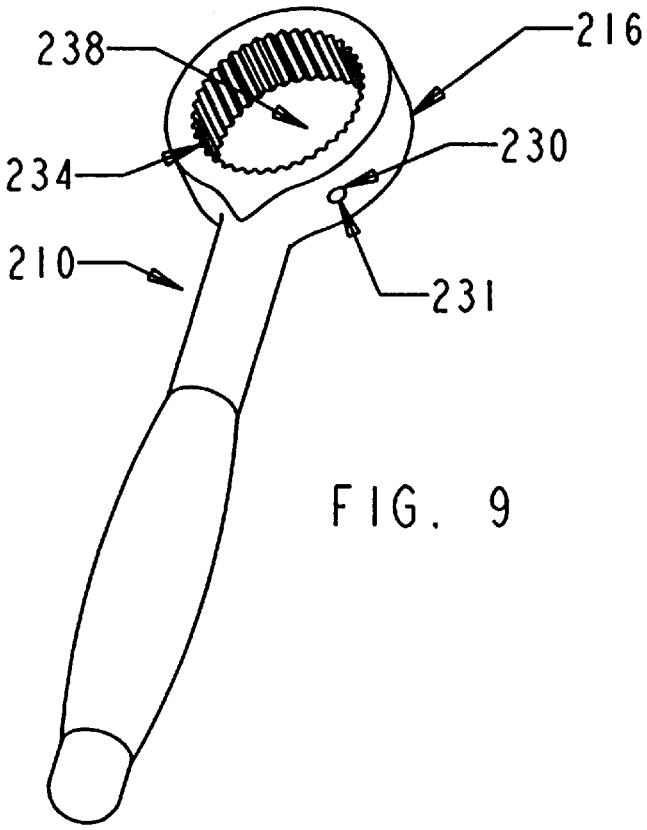
FIGS. 9 and 9A are perspective views of a hand powered ratchet wrench having a lubrication port.
Figure 9A:
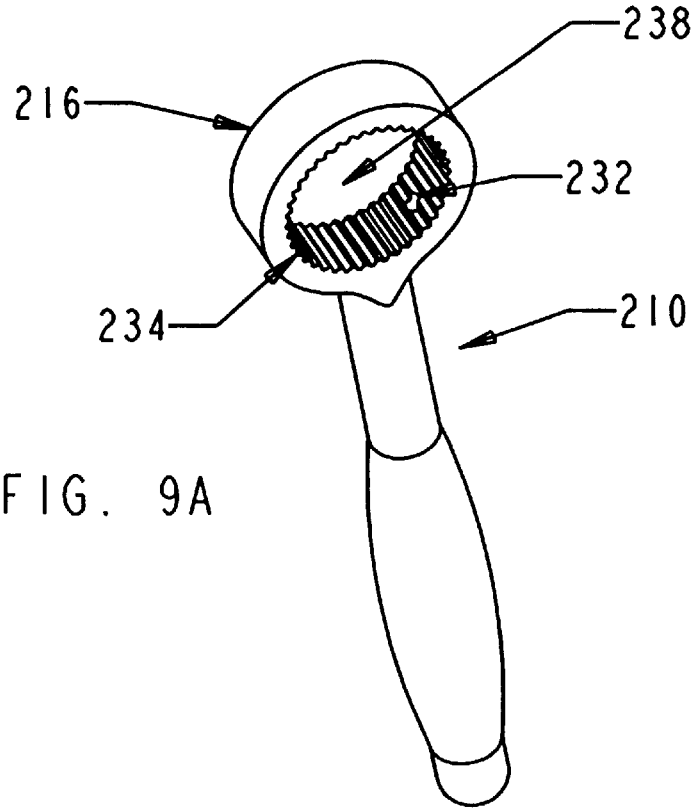

Now referring to FIG. 9 and 9A, there is shown a third embodiment of the present invention. This embodiment consists of a hand operated ratchet wrench 210 as is known in the art having a head 216 with a bore 238 formed within it which receives a ratchet mechanism as herein before described. On the outer circumference of bore 238 are formed teeth 234 which engage the teeth formed on the outer ends of the pawl(s) of a ratchet mechanism which is inserted into the head 216 of wrench 210. Within head 216 is lubrication port 230 with an inlet 231 and an outlet 232.

Grease or other lubricants pass through lubrication port 230 and are applied to the area of engagement between teeth 234 and the teeth formed on the pawl(s) of the ratchet mechanism as the ratchet mechanism rotates within bore 238. Application of lubricant through port 230 also provides for lubrication of the moving components of the ratchet mechanism.

Like the yoke of the previous embodiments described above, lubrication port 230 may have a grease fitting affixed within the outer end of the port 216 to provide the advantages as described herein.

Figure 10:
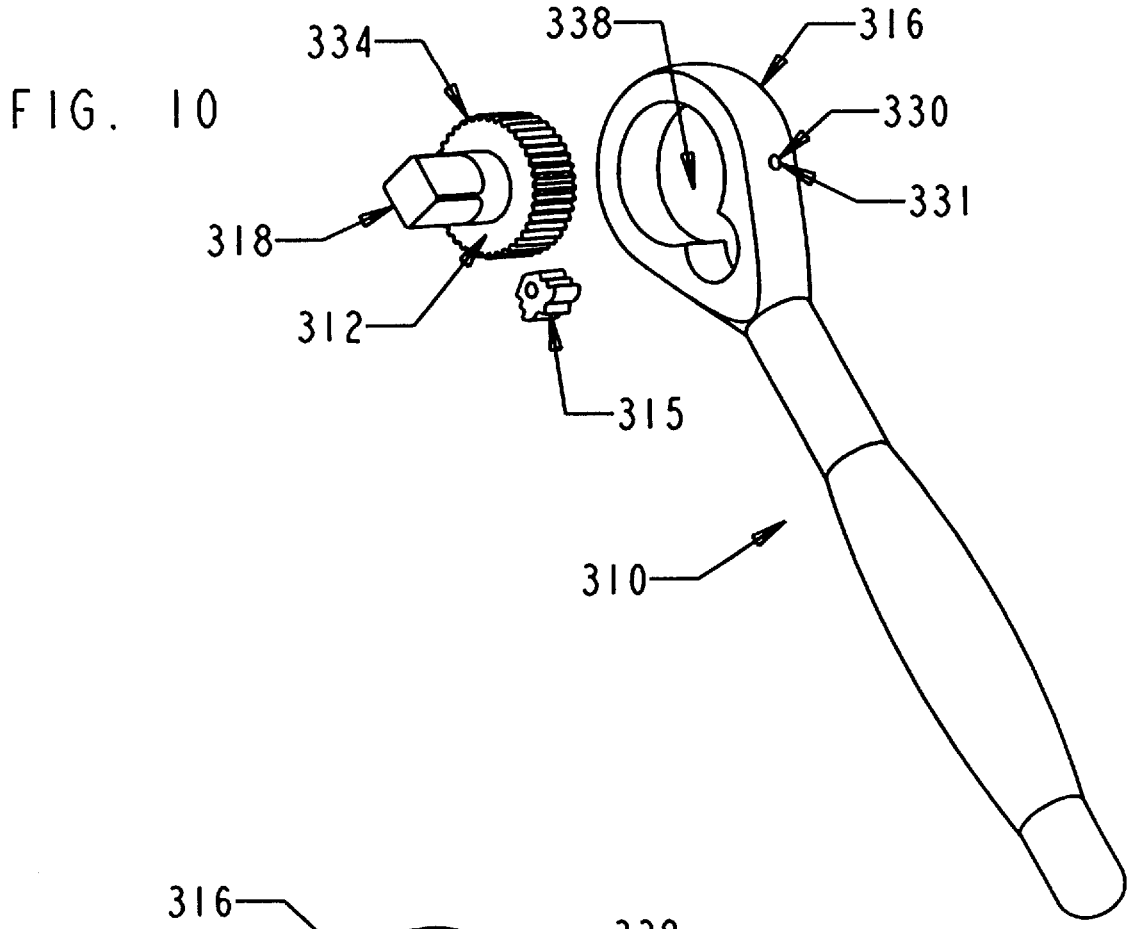
FIG. 10 is an exploded perspective view of a hand powered ratchet wrench having a lubrication port and the ratchet mechanism having teeth formed on its circumference.
Figure 10A:
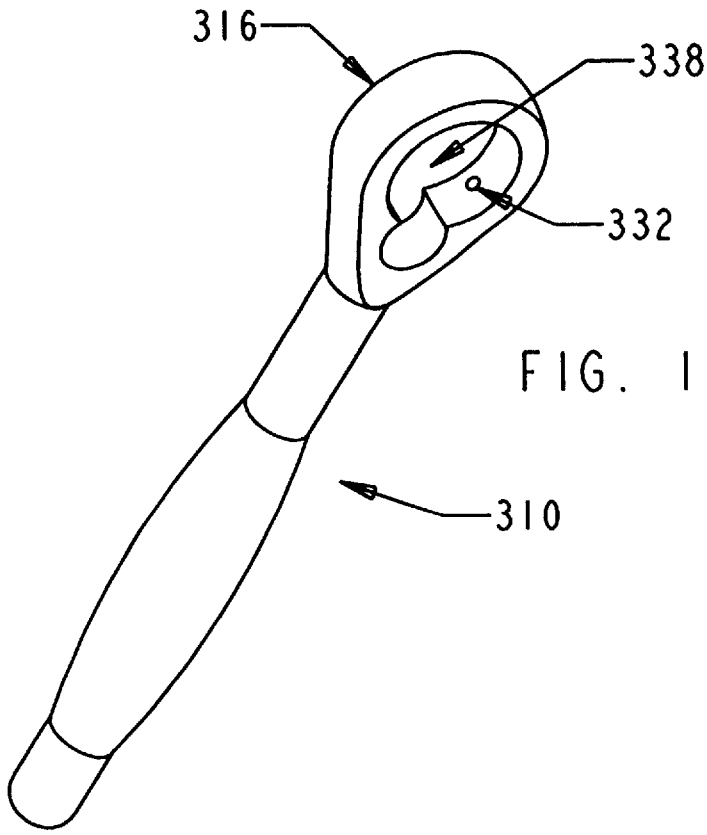
FIG. 10A is a perspective view of a hand powered ratchet wrench having a lubrication port with the ratchet mechanism removed.

In FIGS. 10 and 10A is shown yet another embodiment of the present invention. This embodiment consists of a hand operated ratchet wrench 310 having a head 316 within which is formed two intersecting cylindrical bores creating one figure-eight shaped bore 338 which accepts ratchet mechanism 312. Ratchet mechanism 312 has teeth 334 formed on its outer circumference and drive square 318 extending from the center of ratchet mechanism 312 for engaging a socket. Pawl 315 is mounted within the smaller section of bore 338 and is pivotally connected to the shift lever (not shown). In use, teeth 334 come into contact with teeth formed on the outer ends of pawl 315 to allow for selective rotation of ratchet mechanism 312. Within head 316 is lubrication port 330 having an inlet 331 and an outlet 332.

Grease or other lubricants are applied through port 330 and onto teeth 334. As teeth 334 revolve within bore 338, lubricant is applied to the teeth formed on the outer ends of pawl 315. As with the previous embodiments, port 330 may have a grease fitting affixed within outlet 332 to provide the advantages as herein described.

It is also contemplated that more than one lubrication port may be provided in the embodiments of the ratchet yokes and wrenches described above. Moreover, each of these lubrication ports may be formed having more than one outlet placed along the circumference of the bore of the ratchet head or yoke. Further, the outlets of the lubrication port may be formed in different diameters and/or sizes to allow for application of different amounts of lubrication to different areas of the ratchet wrench as necessary.

Other embodiments and variations of the preferred embodiments described herein will be apparent to those skilled in the art and may be made without departing from the spirit and scope of the invention as defined in the above description.

What is claimed is:

1. A powered ratchet wrench comprising:

a body having a handle portion and a head portion;

a drive motor;

a ratchet mechanism comprising at least one pawl having a plurality of teeth;

said head portion having a bore therein for receiving said ratchet mechanism, and having a plurality of teeth which engage the plurality of teeth of said at least one pawl;

a drive mechanism positioned within said body adjacent said bore;

a lubrication port having an inlet and at least one outlet, said lubrication port communicating lubricant between the outer surface of said head portion and said bore to allow for application of lubrications to the area of engagement between the plurality of teeth of said at least one pawl and said head portion, and concurrently to said drive mechanism position in said body.

2. A powered ratchet wrench as recited in claim 1, further comprising a grease fitting affixed within the inlet of said lubrication port.

3. A powered ratchet wrench as recited in claim 1, wherein said lubrication port further comprises a second outlet.

4. A powered ratchet wrench as recited in claim 1, wherein said wrench is powered by a pneumatic motor.

5. A powered ratchet wrench as related in claim 1, wherein said lubricant port comprises an inlet and at first outlet communicating between said inlet and said bore, and a second outlet communicating between said inlet and said drive mechanism.

6. A powered ratch wrench as recited in claim 1, further comprising a second lubrication port having an inlet and at least one outlet communicating between said bore and said drive mechanism to allow for application of lubricants to said drive mechanism.

7. A powered ratch wrench as recited in claim 6, wherein said first and second lubrication ports intersect at the outlet of said first lubrication port to facilitate distribution of lubrication from the inlet of said first lubrication port to the outlet of said first lubrication port and the outlet of said second lubrication port.

* * * * *